US006517646B2

(12) United States Patent
Tavernier et al.

(10) Patent No.: US 6,517,646 B2
(45) Date of Patent: Feb. 11, 2003

(54) METHOD FOR MANUFACTURING VERY THIN ALUMINUM-IRON ALLOY STRIPS

(75) Inventors: Philippe Tavernier, Mandres (FR); Jacques Gagniere, Rugles (FR); Herve Gehanno, L'Aigle (FR); Sylvain Henry, Voiron (FR); Regine Debreux, Le Touvet (FR); Bruno Chenal, St. Etienne de Crossey (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 09/927,438

(22) Filed: Aug. 13, 2001

(65) Prior Publication Data

US 2002/0043310 A1 Apr. 18, 2002

(30) Foreign Application Priority Data

Aug. 29, 2000 (FR) ..... 00 11025

(51) Int. Cl.[7] ..... C22F 1/04
(52) U.S. Cl. ..... 148/551; 148/696
(58) Field of Search ..... 148/551, 696, 148/692

(56) References Cited

U.S. PATENT DOCUMENTS 5,080,728 A 1/1992 Hasenclever
5,380,379 A 1/1995 Maiwald et al.

FOREIGN PATENT DOCUMENTS

GB 1524355 9/1978
WO 95/25825 9/1995
WO 98/45492 10/1998

OTHER PUBLICATIONS

XP–002169114–E–"Strip Cast Aluminum Foil", Ekstroem et al, Chemical Abstracts, 1996.

*Primary Examiner*—George Wyszomierski
*Assistant Examiner*—Janelle Combs Morillo
(74) *Attorney, Agent, or Firm*—Dennison, Schultz & Dougherty

(57) ABSTRACT

A method for manufacturing aluminum alloy strips with a thickness less than or equal to 12 μm, by obtaining an alloy with composition (weight %):

Si:0.15–0.40; Fe: 1.10–1.70; Mg<0.02; Mn:0.30–0.50; other elements <0.05 each and total <0.15; remainder aluminum;

continuously casting between rolls a strip of this alloy with a thickness between 2 and 10 mm;

homogenizing this strip at a temperature between 450 and 620° C. with a duration between 8 and 40 hrs;

cold-rolling of the homogenized strip;

intermediate annealing of this cold-rolled strip to a temperature between 200 and 400° C., and with a duration between 8 and 15 hrs;

cold-rolling of the annealed strip up to the final thickness less than or equal to 12 μm; and final annealing of the strip at a temperature between 200 and 300° C., with a duration of at least 50 hrs. The method is notably applied to the manufacturing of strips for aseptic food packages of the brick type.

4 Claims, No Drawings

METHOD FOR MANUFACTURING VERY THIN ALUMINUM-IRON ALLOY STRIPS

FIELD OF THE INVENTION

The invention relates to a method for manufacturing very thin strips with a thickness less than or equal to 12 μm, in an alloy of the aluminum-iron type. Such strips are notably used for manufacturing multilayer composites including a paper or cardboard layer, an aluminum alloy layer and a polymer layer, which may be used for making aseptic flexible or stiff food packages of the brick type.

DESCRIPTION OF RELATED ART

The sought-after properties of use for very thin strips of aluminum alloy are good mechanical strength, sufficient elongation, a very low number of holes per unit surface and good tear and bending strength. The absence of holes is essentially related to the grain size which should in any case be less than the final thickness.

Moreover, as regards the industrial manufacturing of the product, it is important that the selected alloy may be cast and rolled easily, that it is not too costly to elaborate, notably that it does not require a too low silicon content and finally that the product's processing range is not too complicated, in particular it should avoid a too large number of heat treatments.

The commonly used alloys for this application are alloys of the 1100 or 1200 type containing less than 1% by weight for the sum of silicon and iron contents. The use of higher iron alloys such as alloys 8006 and 8015, registered at the Aluminum Association in 1978 and 1988, respectively, and the addition of manganese are also known to improve mechanical strength.

The registered composition for 8006 is (% by weight):
Si<0.4 Fe:1.2–2 Cu<0.30 Mn:0.3–1 Mg<0.10 Zn<0.10

The registered composition for 8015 is:
Si<0.30 Fe:0.8.2–1.4 Cu<0.10 Mn:0.10–0.40 Mg<0.10 Zn<0.10

An important drawback of high iron alloys is the difficulty in recycling the manufacturing scrap for other applications; indeed, the manufacture of very thin strips is a delicate operation which leads to an important yield while generating a lot of waste material. A means for avoiding this drawback is to use, for producing the strips, a continuous casting machine, for example, continuous casting between rolls, which enables the direct recycling of scraps and wastes from the process into the machine's melting furnace. This advantage is added to the intrinsic advantages of continuous casting, notably the low investment costs.

U.S. Pat. No. 5,380,379, filed in 1993 on behalf of Alcoa Aluminio Do Nordeste, describes an aluminum strip with composition (% by weight):
Si<0.2 Fe:1.35–1.6 Cu<0.1–0.4 Mn:0.3–0.6 B:0.01–0.02 made by continuous casting between rolls, to a thickness between 4.8 and 10 mm, annealed at more than 450° C. and cold-rolled. If the final thickness of the strip is less than 9 μm, the patent recommends extra-intermediate annealing.

Patent EP 0750685 (Alcan International), filed in 1994, relates to a thin foil with a thickness between 5 and 40 μm, with composition (% by weight):
Si<0.4 Fe:1.2–2.0 Mn:0.2–1.0 Mg and/or Cu:0.1–0.5 Zn<0.1 with an average grain size less than 5 μm after final annealing. The metal may be cast by conventional semi-continuous casting or by continuous casting between rolls or between belts.

The WO 98/45492 Patent application (Alcan International) describes a recyclable thin foil, notably for household applications, with composition:
Si:0.2–0.5 Fe:0.4–0.8 Cu<0.1–0.3 Mn:0.05–0.3 containing at least 2% by weight of dispersoids and at least 0.1% of copper and/or manganese in a solid solution. The alloy is continuously cast and an intermediate annealing is performed during the cold-rolling.

SUMMARY OF THE INVENTION

The object of the invention is to provide a method for manufacturing aluminum-iron type alloy strips with a thickness less than or equal to 12 μm, and preferably less than 9 μm, by using continuous casting between rolls, and leading to strips having both good mechanical strength and high tear and bending strength, in technical and economical conditions compatible with large-scale industrial production. The object of the invention is a method for manufacturing aluminum alloy strips with a thickness less than or equal to 12 μm, and preferably<9 μm, including:

elaboration of an alloy with composition (% by weight):
Si:0.15–0.40 Fe:1.10–1.70 Mg<0.02 Mn:0.30–0.50 other elements<0.05 each and total<0.15, remainder is aluminum, continuous casting between rolls of a strip of this alloy with a thickness between 2 and 10 mm, homogenization of this strip at a temperature between 450 and 620° C. with a duration between 8 and 40 hrs, cold-rolling of this strip intermediate annealing of the cold-rolled strip at a temperature between 200 and 400° C., and with a duration between 8 and 15 hrs, cold-rolling of the annealed strip to a final thickness less than or equal to 12 μm, final annealing of the strip at a temperature between 200 and 300° C., with a duration of at least 50 hrs.

DETAILED DESCRIPTION OF THE INVENTION

The method according to the invention combines a particular composition within the AA composition of 8006, and a manufacturing range, leading to attractive properties of use for manufacturing composites for food packages, while avoiding penalty inflicting constraints at an industrial level.

The composition of the alloy has a silicon content between 0.15 and 0.40%, which does not require the use of pure base and so does not have to be particularly under control, unlike the teaching of U.S. Pat. No. 5,380,379 which recommends a silicon content less than 0.2% in order to prevent the formation of intermetallic compounds AlFeSi and AlMnSi. The iron content, between 1.1 and 1.7% and preferably<1.4%, is located in the low range of 8006, and is located in that of 8015. Manganese content, between 0.3 and 0.5% is itself also in the lower range of 8006. Magnesium and copper contents are kept at low levels.

The alloy is cast by means of a machine for the continuous casting of strips between two cooled rolls, such as for example Jumbo 3C™ of Pechiney Rhenalu. Casting is performed at a thickness between 2 and 10 mm, at a casting rate between 0.5 and 3 m/min. It is possible to recycle all the manufacturing wastes and scraps into the feed oven of the machine. The cast strip is then homogenized at a temperature between 450 and 620° C. for a duration between 8 and 40 hrs, then slowly cooled.

First stage cold-rolling is then performed to a thickness between 0.8 and 0.3 mm, followed by intermediate annealing at a temperature between 200 and 400° C., in order to obtain a fine structure, and preferably between 320 and 370° C. to obtain a recrystallized structure, with a grain size, less than 30 μm and preferably 15 μm. The strip is then cold-rolled to the final thickness according to the usual technique, then submitted to a final degreasing by annealing at a temperature between 200 and 300° C., for a duration of at least 50 hrs, notably depending on the width of the strip.

The strips according to the invention have an ultimate tensile strength larger than 100 MPa, a yield strength larger than 80 MPa, an elongation larger than 3% and a porosity of less than 10 holes per $dm^2$ according to the EN 546-4 standard. They also have improved tear and bending strength as compared with strips from the conventional casting process.

It may be noted that a strip of less than 12 μm is obtained with quite satisfactory properties of use by only having one intermediate annealing, whereas, for the same thickness range, U.S. Pat. No. 5,380,379 recommends a first intermediate annealing between 200 and 250° C., at a thickness between 0.31 and 0.38 mm, then a second intermediate annealing between 200 and 300° C., at a thickness between 20 and 45 μm.

These performances are obtained by specifically controlling the recrystallization by means of the size, morphology and distribution of the inter-metallic particles. A homogenous distribution of particles of a sufficiently large size and maximum desaturation of the manganese solid solution lead to recrystallization with fine and homogenous grains, which contribute to the good mechanical properties, notably the tear and bending strength, as well as to the low porosity of the product.

Strips obtained by means of the method according to the invention, are particularly suitable for manufacturing multilayer composites, for example, paper- or cardboard-aluminum-polymer composites for making aseptic food packages of the brick type. They may also be used exposed, lacquered or varnished for various types of packages.

EXAMPLES

Example 1

An alloy was prepared with composition: Si=0.23% Fe=1.26% Cu=0.017% Mn:0.37% Mg=0.0032% Ti=0.008%

The alloy was cast with a width of 1500 mm, a thickness of 8 mm and at a rate of 0.96 m/min between two cooled rolls on a casting machine of the Jumbo 3C™ brand from Pechiney Rhenalu. The cast strip was homogenized for 12 hrs at a temperature of 600° C. The strip was then cold-rolled to a thickness of 0.5 mm and then submitted as a roll to intermediate annealing for 12 hrs at 350° C., so that the metal recrystallizes with fine grains. It was then rolled again to a final thickness of 6.60 μm, and then submitted to a final degreasing annealing for about 80 hrs at 280° C.

The ultimate tensile strength $R_m$, the conventional yield strength $R_{0.2}$ (MPa) at 0.2% elongation and the elongation A (%) were measured, by comparing them with the properties of cast strips in 1200 alloy with the same thickness in a traditional semi-continuous casting process. The results are shown in Table 1.

TABLE 1

| | Invention | 1200 |
|---|---|---|
| $R_m$ (MPa) | 103 | 73 |
| $R_{0.2}$ (MPa) | 86 | 50 |
| A (%) | 3.2 | 2.7 |

The porosity of the strip was also measured by the number of holes per $dm^2$ according to the EN 546-4 standard. This porosity is of 6 holes per $dm^2$, to be compared to a mean value of 13 holes per $dm^2$ for the 1200 alloy in a standard casting process.

Example 2

Tear strength tests were performed for foils cut out of 1200 alloy strips from the standard casting process and with thicknesses 6.3, 6.6 and 9 μm, and of strips according to the invention with the same thicknesses. The tests were conducted by using the Elmendorf method according to the EN 21974 standard (ISO 1974). The test consists of determining the required force for propagating a tear on a test piece. A first test without any predefined slit gives an indicator of the crack initiation and propagation strength, and a second one with a predefined slit provides quantification of the propagation strength, alone. The force selected from the list of paragraph 1 of annex A of the standard is 4 N for initiated tearing and 32 N for non-initiated tearing. Each test piece consists of a sandwich of 8 foils, with the rolling direction coinciding with the crack propagation direction. The results (an average over several tests) relating to the average required force F1 for tearing (with crack initiation) and F2 (without any crack initiation) are gathered in Table 2.

TABLE 2

| Alloy | Thickness (μm) | F1 (mN) | F2 (mN) |
|---|---|---|---|
| 1200 | 6.3 | 52 | 236 |
| 1200 | 6.9 | 53 | 224 |
| 1200 | 9 | 45 | 280 |
| Invention | 6.3 | 78 | 435 |
| Invention | 6.6 | 56 | 440 |
| Invention | 9 | 94 | 560 |

It is seen that the foils according to the invention have a higher tear strength than those elaborated by the standard casting process.

Example 3

Bending strength measurements were performed according to the ISO 5616 standard, by using the Lhomargy apparatus. The bending stress is produced by a reciprocating movement of a slit located between 4 rolls which control the bending angle. The device for fixing the strip and the tensile stress were slightly changed in order to account for the difference between aluminum and paper. The distance between the jaws was extended to 35 mm (instead of 28,5 mm) and the counterweight system was adjusted for producing tensile forces of 0.4 N, 1.7 N and 3 N (instead of 9.81 N and 8 N). The samples used have dimensions of 170 mm×15 mm (instead of 100×15 mm), the rolling direction is aligned with the bending blade, i.e., perpendicular to the direction of the tensile stress. The tests were performed on 1200 alloy strips with a thickness of 6.6 and 9 μm, from the standard casting process, and on strips according to the invention with the same thicknesses.

The number of cycles C with breaking was measured for different types of stresses (tensile force and stress). The results (averaged over several tests) are shown in Table 3.

TABLE 3

| Alloy/thickness | Tensile force (N) | Stress (MPa) | C |
|---|---|---|---|
| 1200 6.6 μm | 0.4 | 4 | 170 |
| | 1.7 | 17 | 45 |
| | 3 | 30 | 26 |
| | 8 | 80 | 5 |
| Invention 6.6 μm | 0.4 | 4 | 184 |
| | 1.7 | 17 | 50 |
| | 3 | 30 | 29 |
| | 8 | 80 | 8 |
| 1200 9 μm | 0.4 | 3 | 209 |
| | 1.7 | 13 | 47 |
| | 3 | 22 | 27 |
| Invention 9 μm | 0.4 | 3 | 184 |
| | 1.7 | 13 | 45 |
| | 3 | 22 | 33 |

It is seen that the strips according to the invention, although of higher mechanical strength, have a rather better bending strength than the 1200 alloy from the standard casting process for the 6.6 μm thickness, and roughly equivalent for the 9 μm thickness.

What is claimed is:

1. Method for manufacturing aluminum alloy strips with a thickness less than or equal to 12 μm, including:

obtaining an alloy with a composition consisting essentially of, in % by weight:

Si: 0.15–0.40; Fe:1.10–1.70; Mg<0.02; Mn:0.30–0.50;

other elements <0.05 each and total <0.15; remainder aluminum;

continuously casting between rolls a strip of said alloy with a thickness between 2 and 10 mm;

homogenizing said strip at a temperature between 450 and 620° C., for a duration between 8 and 40 hrs;

cold-rolling said homogenized strip;

intermediate annealing of the cold-rolled strip at a temperature between 200 and 400° C., and with a duration between 8 and 15 hrs;

cold-rolling of the annealed strip to the final thickness less than or equal to 12 μm; and final annealing of the strip at a temperature between 200 and 300° C., with a duration of at least 50 hrs.

2. The method according to claim 1, wherein the thickness of the strip is less than 9 μm.

3. The method according to claim 1, wherein the alloy contains less than 1.40% iron.

4. The method according to claim 1, wherein the intermediate annealing is the sole step between the cold-rolling steps.

* * * * *